US006317024B1

(12) United States Patent
Orii

(10) Patent No.: US 6,317,024 B1
(45) Date of Patent: Nov. 13, 2001

(54) RESISTOR FOR AUDIO EQUIPMENT

(75) Inventor: Taiko Orii, Nagano-ken (JP)

(73) Assignee: Takman Electronics Co., Ltd.

( * ) Notice: Subject to any disclaimer, the term of this patent is extended or adjusted under 35 U.S.C. 154(b) by 0 days.

(21) Appl. No.: 09/635,774

(22) Filed: Aug. 11, 2000

(30) Foreign Application Priority Data

Oct. 15, 1999 (JP) ..... 11-330369

(51) Int. Cl.[7] ..... H01C 1/02

(52) U.S. Cl. ..... 338/276; 338/233; 338/236; 338/243; 338/271; 338/273; 338/307

(58) Field of Search ..... 338/61, 64, 226, 338/233, 234, 236, 237, 243, 244, 245, 246, 247, 251, 271, 273, 274, 276, 277, 294, 307

(56) References Cited

U.S. PATENT DOCUMENTS

| | | | | |
|---|---|---|---|---|
| 2,898,570 | * | 8/1959 | Patrichi | 338/226 |
| 3,136,972 | * | 6/1964 | Randolph | 338/274 |
| 3,136,973 | * | 6/1964 | Randolph | 338/274 |
| 3,173,121 | * | 3/1965 | Murry | 338/226 |
| 3,173,122 | * | 3/1965 | Murry | 338/273 |
| 3,199,058 | * | 8/1965 | Cramor | 338/274 |
| 3,803,528 | * | 4/1974 | Wellard | 338/257 |
| 4,016,527 | * | 4/1977 | Francis et al. | 338/274 |
| 4,678,890 | * | 7/1987 | Sorrow | 338/226 |

FOREIGN PATENT DOCUMENTS

| | | |
|---|---|---|
| 61-34901 | 2/1986 | (JP) . |
| 1-130501 | 9/1989 | (JP) . |
| 3-288401 | 12/1991 | (JP) . |

* cited by examiner

*Primary Examiner*—Karl D. Easthom
(74) *Attorney, Agent, or Firm*—Burns, Doane, Swecker & Mathis, L.L.P.

(57) ABSTRACT

A resistor 1 is used in high-fidelity amplifiers for audio equipment. The resistor 1 includes a cylindrical resistor body 2, a tubular sheath 3 into which the resistor body 2 is coaxially inserted, and a conductive film portion 31*a* formed on the inside surface 3*a* of the sheath 3. The conductive film portion 31*a* faces to a resistance film 22 covering the surface of the resistor body 2 with an annular space 6. An insulating slit 32 is formed at a central point along the resistor axis 1*a*, separating the conductive film 31 into left and right parts that are electrically isolated from each other. The sheath covering the resistor body 2 prevents distortion of signals in the resistance film 22 caused by extraneous electrostatic induction charges.

21 Claims, 3 Drawing Sheets

Fig.1
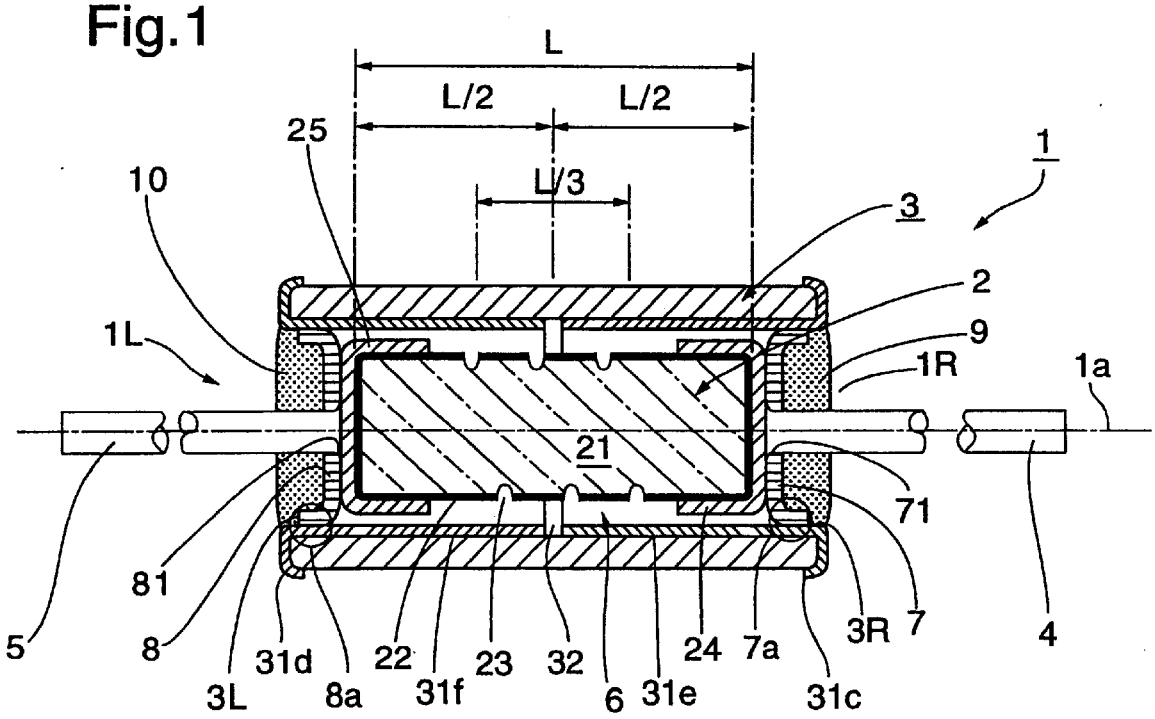
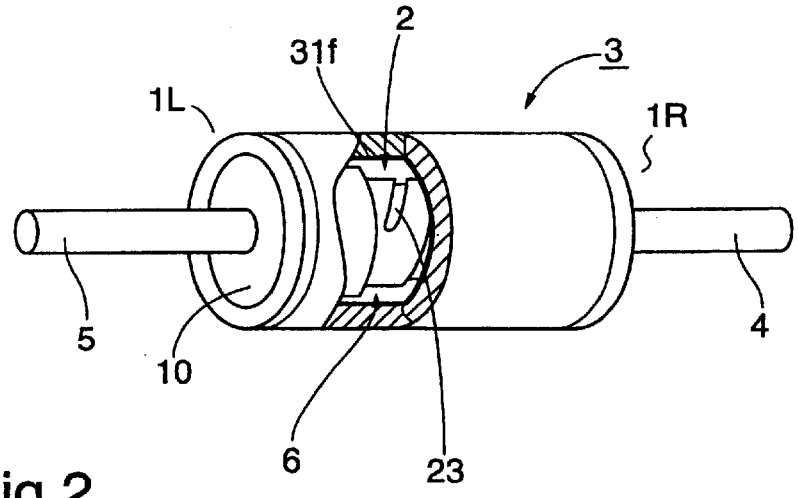
Fig.2

Fig.3
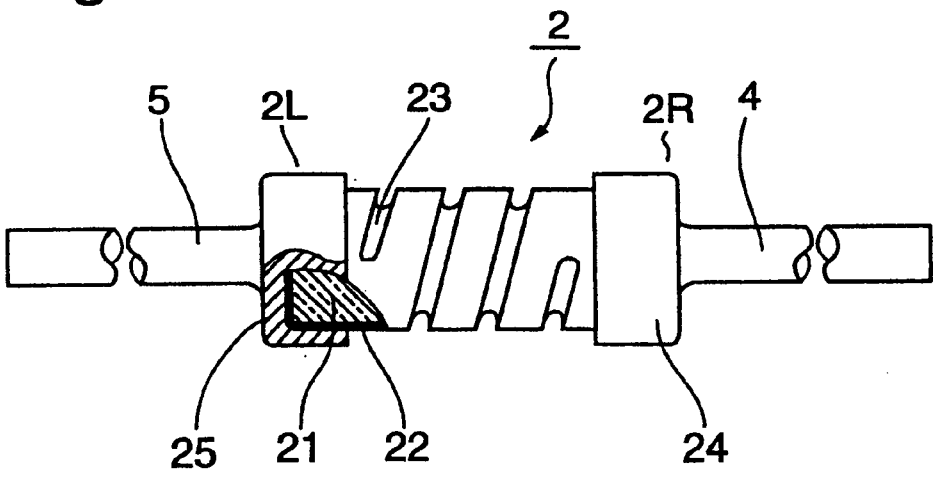
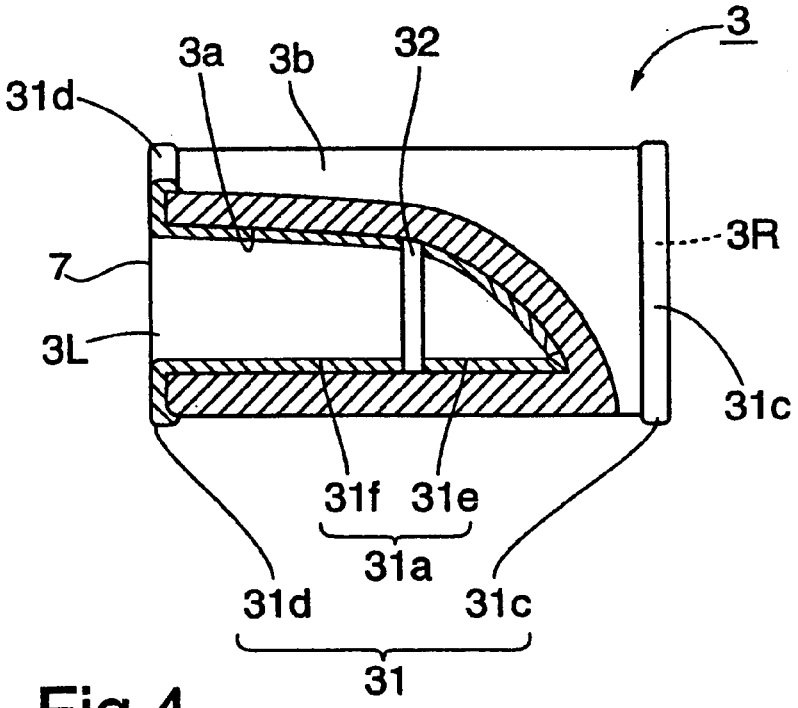
Fig.4

RESISTOR FOR AUDIO EQUIPMENT

BACKGROUND OF THE INVENTION

1. Field of the Invention

This invention relates to a resistor for audio equipment adapted for use in a high-fidelity amplifier in audio equipment.

2. Prior Art Description

In audio equipment, a high-fidelity amplifier is used to amplify the low level signals and reproduce sounds with good quality. Even slight variations in the electrical characteristics of the resistors used in high-fidelity amplifiers result in a major degradation of the sound quality. This has given rise to proposals to suppress variations in the characteristics of resistors caused by extraneous signal noise, to prevent the amplifier circuitry from being adversely affected.

JP-A 61-34901, for example, discloses an induction array of resistors for audio equipment applications in which, in order to improve the quality of reproduced sound, the induction field generated when electricity passes through the resistance film is utilized to minimize distortion with respect to the signal current.

In another example, JP-A 3-288401 relates to a shielded resistor comprising alternating layers of a magnetic film and a conductive film, in which extraneous noise is converted into heat energy, which is radiated away to prevent noise affecting the resistor in the shielding.

In another disclosure, JU-A 1-130501, the inside surface of the resistor carrier is formed in strips and the outside of the carrier is covered with shielding.

In all of the prior art resistors, the surface of the resistance film is sheathed to insulate the resistance film from the outside air. In one method, for example, the sheathing is coated on. The sheathing is usually a dielectric, so it is readily charged by external electrostatic induction. When this happens, there is a high possibility of the charge carriers causing variation in the electrical characteristics of the resistance film.

Moreover, when a magnetic sheathing is used, there is a high risk of the magnetism giving rise to phase distortion of signals applied to the resistor.

When the resistor carrier is cylindrical and comprises strips of resistance film on the inside surface and shielding on the outside surface, the shielding prevents the resistance film from being affected by the magnetism. However, with the shielding and resistance film being formed integrally with the resistor carrier, the signal flowing through the resistance film charges the resistor carrier, which can adversely affect signals applied to the resistor.

Also, a CLT-1 tester (made by Radiometer AS Copenhagen) or the like can be used to test the linearity of such resistors. At more than 120 db, the third high-frequency component included in a 10 KHz signal is known to be low. However, an examination into the factors causing variations in the characteristics of such resistors revealed the following. The present inventor used a Hewlett-Packard 4284A LCR Meter to measure the inductance produced when resistance films are subject to spiral cutting, and the capacitance resulting from using sheathing to directly protect the resistance films. At high audio frequencies, no inductance component was detected, just a change in the capacitance component of 40 db or more.

These results reveal that the sound sensitivity is affected not by the inductance component of the resistor, but only by the capacitance component, which depends on the dielectric sheathing. That is, the sheathing is in direct contact with the resistance film and therefore is charged by electrostatic induction, thereby affecting signals applied to the resistance film.

Based on these findings, the object of the present invention is to provide a resistor for audio equipment that is able to prevent audio replay containing unusual sound quality caused by the effect on the characteristics of a resistance film caused by the resistor sheath becoming charged by electrostatic induction.

SUMMARY OF THE INVENTION

To attain the above object, the present invention provides a resistor for audio equipment, comprising: a resistor body; a first electrode attached to a first end of the resistor body; a second electrode attached to a second end of the resistor body; the resistor including a substrate, a resistance film formed to cover the substrate surface, and a groove of constant width formed in the resistance film, exposing the substrate surface; a sheath formed to encompass the resistance film formed with a space around the outer surface of the resistor body; and a conductive film formed on an internal surface of the sheath; the conductive film having an annular insulating slit formed at a predetermined position along an axial line of the resistor body that exposes the sheath surface, whereby the resistor body is axially separated into a first conductive film portion and a second conductive film portion.

The conductive film does not have to be formed only on the inside surface of the sheath, but may be formed so as to also cover the outside surface of the sheath.

Also, it is preferable for the insulating slit to be formed at a central point along the axis of the resistor body.

With this configuration, the fact that the resistance film is formed on the resistor surface facing the conductive film on the sheath side, with a space therebetween, makes it more difficult for the resistance film to be subjected to the effects of extraneous electrostatic induction.

The part of the resistance film facing the insulation slit formed at a point in the conductive film midway along the resistor body will probably become charged slightly. However, the charge produced in the insulation slit by the electrostatic induction and the charge produced by signals applied to the conductive film will cancel each other out. Therefore, the electrostatically induced charge on the sheath prevents signals applied to the resistance film from having an effect.

Incorporating the resistor of the invention in an amplifier will prevent the signals from being affected by extraneous noise, thereby ensuring the fidelity of the reproduced sound.

The resistor of this invention can also include first and second cap electrodes set into the ends of the sheath. In this case, a configuration can be used in which the first electrode is inserted between the first cap electrode and the first end of the resistor, and the second electrode is inserted between the second cap electrode and the second end of the resistor. Also, it is preferable in this case for the space between the resistance film and the conductive film on the sheath to be sealed by the cap electrodes. The space can be filled with air or inert gas.

Alternatively, the sealed state can be used to maintain a state of reduced pressure in the space.

Filling the space between the resistance film on the resistor body and the conductive film formed on the sheath with air or inert gas is an effective way of suppressing the adverse effect on the resistance film of the electrostatic induction of the sheath. This can also be done by using a reduced-pressure gap.

It is preferable to use a sealant to ensure the cap electrodes inserted into the ends of the sheath form a hermetic seal.

The resistor of the invention can also include a first lead wire that passes through the first cap electrode to the first electrode, and a second lead wire that passes through the second cap electrode to the second electrode. In this case, it is preferable for sealant to be used where the lead wires pass through the cap electrodes to provide a hermetic seal.

Further features of the invention, its nature and various advantages will become more apparent from the accompanying drawings and following detailed description of the invention.

BRIEF DESCRIPTION OF THE DRAWINGS

FIG. 1 is a diagram showing a longitudinal cross-sectional view of a resistor according to a first embodiment of the invention.

FIG. 2 is a diagram showing a partially cutaway perspective view of the resistor of FIG. 1.

FIG. 3 is a diagram showing a partially cutaway front view of the body of the resistor of FIG. 1.

FIG. 4 is a diagram showing a partially cutaway front view of the sheath of the resistor body of FIG. 1.

DETAILED DESCRIPTION OF THE PREFERRED EMBODIMENT

Figure 5:
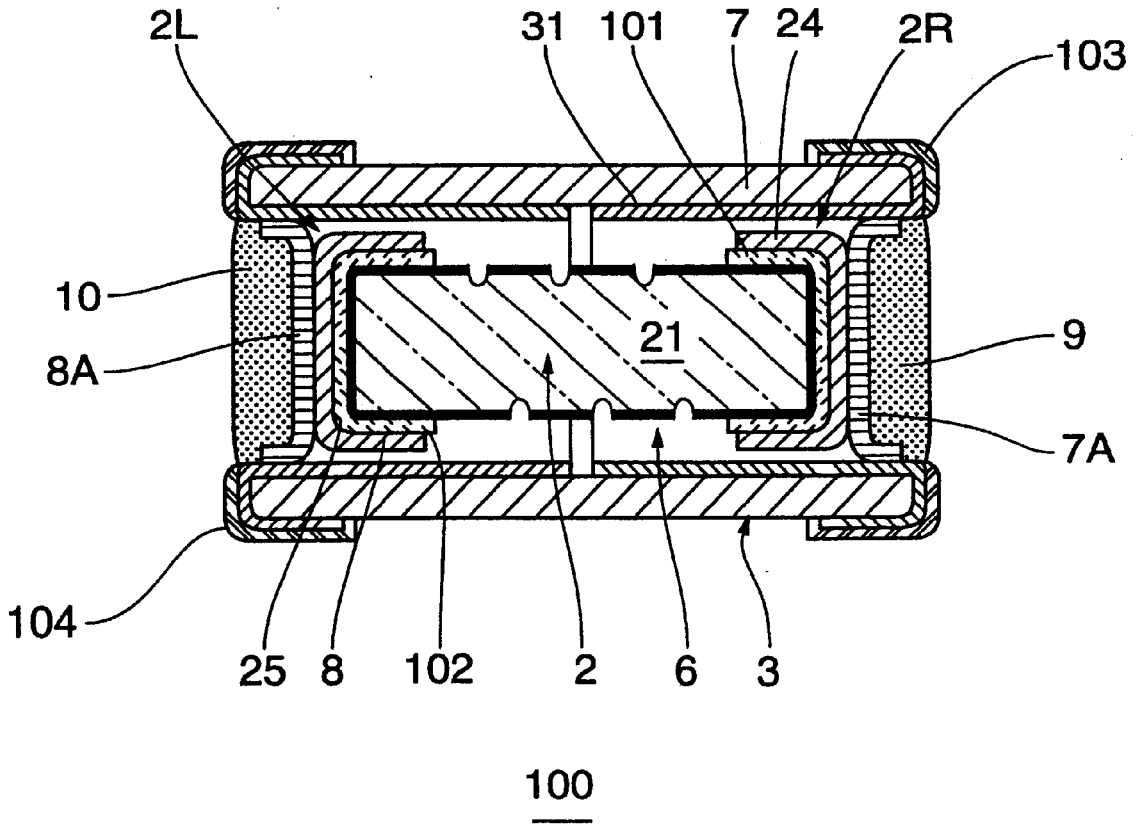
FIG. 5 is a diagram showing a longitudinal cross-sectional view of a leadless resistor according to a second embodiment of the invention.

Embodiments of the resistor of the invention applied to audio equipment will now be described with reference to the drawings. The embodiments are for explaining the invention and are not intended to be limitative.

FIRST EXAMPLE

FIGS. 1 to 4 show the resistor according to a first embodiment of the invention. As shown by the drawings, a resistor 1 for audio equipment comprises a cylindrical resistor body 2, a tubular sheath 3 that covers the resistor body 2, a first lead wire 4 extending from a resistor first end 1R along axis 1*a*, and a second lead wire 5 extending from a resistor second end 1L along axis 1*a*. A space 6 having an annular section is formed between the resistor body 2 and the sheath 3.

The resistor body 2 includes a cylindrical ceramic substrate 21. A resistance film 22 of a prescribed thickness is formed over the whole of the surface of the substrate 21. The resistance film 22 is comprised of carbon, nickel-chrome, tin oxide or the like, and can be formed by a coating method such as pyrolysis, sputtering, plating and the like. A spiral groove 23 having a constant width is formed in the resistance film, exposing the substrate surface. The groove 23 is used to adjust the resistance of the resistor 1.

A cap electrode of a conductive material such as metal is fitted into each end of the resistor body 2. More specifically, a first cap electrode 24 is fixed into place in the first end 2R of the resistor body 2, and a second cap electrode 25 is fixed into place in the second end 2L of the resistor body 2. First and second lead wires 4 and 5 are welded coaxially to the outside end surface of the first and second lead wires 4 and 5, respectively.

The outer sheath 3 protecting the resistor body 2 is formed of an insulating material such as ceramic or glass. A conductive film 31 is formed on at least the inside surface 3a of the sheath 3. This can be done by coating or plating the conductive film 31 onto the inside surface 3*a*. In this example, the conductive film 31 comprises a conductive film portion 31*a* formed on the inside surface 3*a*, and conductive film portions 31*c* and 31*d* that continue on from the conductive film portion 31*a* and extend to the edge portion on the outside surface 3*b* at each end of the sheath 3.

An insulating slit 32 formed at a central point along the resistor axis 1*a* separates the conductive film 31 into left and right parts that are electrically isolated from each other.

By means of the insulating slit 32, the conductive film portion 31*a* is divided into a first portion comprising a right-side portion 31*e* and conductive film portion 31*c*, and a second portion comprising a left-side portion 31*f* and conductive film portion 31*d*.

The resistor body 2 inserted into the sheath 3 is affixed coaxially within the sheath by dish-shaped cap electrode plates 7 and 8 fitted at the ends. The cap electrode plates 7 and 8 have centrally located through-holes 71 and 81 for the lead wires 4 and 5. The cap electrode plates 7 and 8 are each given an outside diameter that allows them to be fixed in place in the end openings 3R, 3L of the sheath 3. Thus, when the resistor body 2 is inserted into the sheath 3 and the cap electrode plates 7 and 8 are plugged into the openings 3R and 3L, the resistor body 2 can be maintained in a prescribed position within the sheath 3 by inserting the cap electrode plates 7 and 8 until they abut the cap electrodes 24 and 25.

In this example, the surfaces of the cap electrode plates 7 and 8 inserted into the openings 3R and 3L are coated with an epoxy sealant 9 and 10. Thus, the insertion portions 7*a* and 8*a* of the cap electrode plates 7 and 8 and the take-off portions for the lead wires 4 and 5 are completely sealed off from the outside. The sealant 9 and 10 also serves to keep the space 6 in an airtight state.

The smaller the volume of the airtight space 6 is the better. It is also preferable to fill the space 6 beforehand with air or inert gas. Alternatively, the space 6 can be maintained in a state of reduced pressure.

In the resistor 1 for audio equipment thus configured, the sheath 3 faces the resistor body 2 from which it is separated by the space 6, so the resistance film 22 facing the conductive film portion 31*a* does not become charged by extraneous electrostatic induction.

With respect to the insulating slit 32 formed in the conductive film 31, extraneous charges arising from electrostatic induction and charges arising from signals applied via the conductive film 31 cancel each other out, leaving the resistance film 22 unaffected by the electrostatic induction. Therefore, the signals flowing in the resistor 1 do not become distorted.

Moreover, because the resistance film 22 and the conductive film 31 of the sheath 3 are separated by the space 6, there is no need to specify the thickness of the sheath 3. This means there is more freedom of choice with respect to the shape of the sheath 3, facilitating manufacture.

In this example the insulating slit 32 is formed at a central point along the axis of the resistor body 2. Thus, as shown in FIG. 1, if the length of the resistor body 2 is L, the insulating slit 32 is formed at a point L/2. Although it is preferable for the slit position to be in the middle of the resistor body 2, the prescribed effect can be obtained if the slit is located within one-third of the resistor body length L, with said one-third centering on the middle of the resistor body 2.

It is preferable for the insulating slit 32 to be narrow. The sheath can be formed in various shapes depending on the shape of the substrate. When the resistor substrate is cylindrical or square, it is preferable to reduce the surface area of the substrate and reduce the volume of the space between the resistance film and the conductive film formed on the surface of the sheath.

SECOND EXAMPLE

FIG. 5 is a diagram showing a longitudinal cross-sectional view of a leadless resistor according to a second embodiment of the invention. Except for the fact that the resistor 100 of this example is leadless, the basic configuration is the same as that of the first embodiment. Therefore, with reference to FIG. 5, identical parts have been given the same reference numbers or symbols, and only different parts will be described here.

With respect to the resistor 100, internal electrodes 101, 102, made of conductive material, are attached to end portions 2R, 2L of the resistor body 2, and over these are fitted conductive cap electrodes 24 and 25. Cap electrode plates 7A and 8A do not have through-holes for leads. Annular external electrodes 103 and 104, formed of conductive material, are affixed at the ends of the sheath 3, over the annular end faces and outer peripheral portions. The external electrodes 103 and 104 have electrical continuity with the conductive film 31 covering the surface of the sheath 3. The leadless resistor 100 thus configured provides the same function and effect as the resistor 1 of the first embodiment.

What is claimed is:

1. A resistor for audio equipment, comprising:

a resistor body;

a first cap electrode attached to a first end of the resistor body;

a second cap electrode attached to a second end of the resistor body;

the resistor body including a substrate, a resistance film formed to cover a surface of the substrate, and a groove of constant width formed in the resistance film, exposing the substrate surface;

a sheath for encompassing a portion of the resistance film formed on the resistor body in a condition that a space is formed around the outer surface of the resistor body; and a conductive film formed on an internal surface of the sheath;

wherein the conductive film has an annular insulating slit formed at a predetermined position along an axial line of the resistor body that exposes an internal surface of the sheath, whereby the conductive film is axially separated into a first conductive film portion and a second conductive film portion, the insulating slit is located inside the first and second cap electrodes along an axial line of the resistor body, and the insulating slit is located within one-third of the resistor body length, with said one-third centering on a middle of the resistor body.

2. A resistor for audio equipment according to claim 1, wherein the conductive film continues on from an inside surface of the sheath to an outside surface of the sheath.

3. A resistor for audio equipment according to claim 1, wherein the insulating slit is formed so that its width center is located at a central position along an axial line of the resistor body.

4. A resistor for audio equipment according to claim 1, wherein openings at each end of the sheath have first and second cap electrode plates inserted therein, with the first cap electrode being inserted between the first cap electrode plate and a first end of the resistor body, and the second electrode cap being inserted between the second cap electrode plate and a second end of the resistor body.

5. A resistor for audio equipment according to claim 4, wherein the space is formed in a sealed state by the resistor body, the sheath and the first and second cap electrodes, in which space a gas is sealed in.

6. A resistor for audio equipment according to claim 5, wherein the gas is air or inert gas.

7. A resistor for audio equipment according to claim 4, wherein the space is formed in a sealed state by the resistor body, the sheath and the first and second cap electrodes, in which space a state of reduced pressure is maintained.

8. A resistor for audio equipment according to claim 5, wherein the space is maintained in a state of reduced pressure.

9. A resistor for audio equipment according to claim 4, wherein portions of the first and second cap electrodes inserted into end openings of the sheath are affixed with a sealing material to provide a seal against outside air.

10. A resistor for audio equipment according to claim 4, further including a first lead wire that passes through the first cap electrode to the first electrode, and a second lead wire that passes through the second cap electrode to the second electrode, with sealing material being used where the first and second lead wires pass through the first and second cap electrodes to provide a seal against outside air.

11. A resistor for audio equipment, comprising:

a resistor body;

a first cap electrode attached to a first end of the resistor body;

a second cap electrode attached to a second end of the resistor body;

the resistor body including a substrate, a resistance film formed to cover a surface of the substrate, and a groove of constant width formed in the resistance film, exposing the substrate surface;

a sheath for encompassing a portion of the resistance film formed on the resistor body in a condition that a space is formed around the outer surface of the resistor body; and a conductive film formed on a surface of the sheath, the conductive film extends inwardly from each of the first and second cap electrodes along the surface of the sheath;

wherein the conductive film has an annular insulating slit formed at a predetermined position along an axial line of the resistor body that exposes an internal surface of the sheath, whereby the conductive film is axially separated into a first conductive film portion and a second conductive film portion;

the insulating slit is located inside the first and second cap electrodes along an axial line of the resistor body.

12. A resistor for audio equipment according to claim 11, wherein the insulating slit is located within one-third of the resistor body length, with said one-third centering on a middle of the resistor body.

13. A resistor for audio equipment according to claim 11, wherein the conductive film continues on from an inside surface of the sheath to an outside surface of the sheath.

14. A resistor for audio equipment according to claim 11, wherein the insulating slit is formed so that its width center is located at a central position along an axial line of the resistor body.

15. A resistor for audio equipment according to claim 11, wherein openings at each end of the sheath have first and second cap electrode plates inserted therein, with the first cap electrode being inserted between the first cap electrode plate and a first end of the resistor body, and the second electrode cap being inserted between the second cap electrode plate and a second end of the resistor body.

16. A resistor for audio equipment according to claim 15, wherein the space is formed in a sealed state by the resistor body, the sheath and the first and second cap electrodes, in which space a gas is sealed in.

17. A resistor for audio equipment according to claim 16, wherein the gas is air or inert gas.

18. A resistor for audio equipment according to claim 15, wherein the space is formed in a sealed state by the resistor body, the sheath and the first and second cap electrodes, in which space a state of reduced pressure is maintained.

19. A resistor for audio equipment according to claim 16, wherein the space is maintained in a state of reduced pressure.

20. A resistor for audio equipment according to claim 15, wherein portions of the first and second cap electrodes inserted into end openings of the sheath are affixed with a sealing material to provide a seal against outside air.

21. A resistor for audio equipment according to claim 15, further including a first lead wire that passes through the first cap electrode to the first electrode, and a second lead wire that passes through the second cap electrode to the second electrode, with sealing material being used where the first and second lead wires pass through the first and second cap electrodes to provide a seal against outside air.

* * * * *